US009422648B2

(12) United States Patent
Nedry et al.

(10) Patent No.: US 9,422,648 B2
(45) Date of Patent: Aug. 23, 2016

(54) PLATFORM FOR WEAVING INTERLINKING BANDS

(71) Applicants: Jessica Nedry, Pompano Beach, FL (US); Madeline Nedry, Pompano Beach, FL (US); Gregg Coningsby, Fort Lauderdale, FL (US)

(72) Inventors: Jessica Nedry, Pompano Beach, FL (US); Madeline Nedry, Pompano Beach, FL (US); Gregg Coningsby, Fort Lauderdale, FL (US)

( * ) Notice: Subject to any disclaimer, the term of this patent is extended or adjusted under 35 U.S.C. 154(b) by 0 days.

(21) Appl. No.: 14/315,098

(22) Filed: Jun. 25, 2014

(65) Prior Publication Data

US 2014/0373966 A1 Dec. 25, 2014

(51) Int. Cl.

| | |
|---|---|
| ***D03D 29/00*** | (2006.01) |
| ***D03D 1/00*** | (2006.01) |
| *D03D 41/00* | (2006.01) |

(52) U.S. Cl.

CPC . *D03D 29/00* (2013.01); *D03D 1/00* (2013.01)

(58) Field of Classification Search

CPC ..... D03D 29/00; D04B 3/00; D04B 39/00; D04B 5/00; D04B 33/00; D04B 1/18; A44C 27/00; B65H 69/04; B65H 2701/31; B65H 69/00; A63F 2250/124

See application file for complete search history.

(56) References Cited

U.S. PATENT DOCUMENTS

| | | | | | |
|---|---|---|---|---|---|
| 222,937 | A | * | 12/1879 | Newcomb | 66/4 |
| 246,648 | A | * | 9/1881 | Wilcox | 66/4 |
| 254,258 | A | * | 2/1882 | Barbour | 28/149 |
| 254,288 | A | * | 2/1882 | Dimmick | 28/149 |
| 289,578 | A | * | 12/1883 | Stewart | 66/4 |
| 843,495 | A | * | 2/1907 | Sander | 28/152 |
| 1,318,465 | A | * | 10/1919 | Seifarth | 66/4 |
| 1,318,604 | A | * | 10/1919 | Shneider | 66/4 |
| 1,500,383 | A | * | 7/1924 | Gourie | 66/4 |
| 1,694,849 | A | * | 12/1928 | Fujii | 66/4 |
| 1,705,860 | A | * | 3/1929 | Hagihara | 66/4 |
| 1,718,140 | A | * | 6/1929 | Hagihara | 66/4 |
| 1,776,561 | A | * | 9/1930 | La Croix | 66/4 |
| 2,043,082 | A | * | 6/1936 | Wallach | 28/151 |
| 2,072,668 | A | * | 3/1937 | Eltgroth | 66/4 |
| 2,088,455 | A | * | 7/1937 | Witt | 28/150 |
| 2,108,424 | A | * | 2/1938 | Bakely | 28/150 |
| 2,134,066 | A | * | 10/1938 | Van Ness | 66/4 |
| 2,186,692 | A | * | 1/1940 | Boyer et al. | 139/34 |
| 2,237,733 | A | * | 4/1941 | Grimm et al. | 66/4 |
| 2,270,619 | A | * | 1/1942 | Bowyer | 66/4 |
| 2,274,572 | A | * | 2/1942 | Yates | 66/117 |
| 2,318,018 | A | * | 5/1943 | Semonson | 66/4 |
| 2,360,416 | A | * | 10/1944 | Gray | 28/150 |
| 2,433,307 | A | * | 12/1947 | Thomas | 28/152 |
| 2,450,067 | A | * | 9/1948 | Wolff | 66/4 |
| 2,457,064 | A | * | 12/1948 | Parisl | 66/4 |
| 2,504,940 | A | * | 4/1950 | Wallach | 28/151 |

(Continued)

OTHER PUBLICATIONS

Pedestal. Dictionary.com. Dictionary.com Unabridged. Random House, Inc. http://dictionary.reference.com/browse/pedestal (accessed: Aug. 26, 2015).*

*Primary Examiner* — Bobby Muromoto, Jr.

(74) *Attorney, Agent, or Firm* — Bennett Intellectual Property; Allen F. Bennett

(57) ABSTRACT

A platform for linking elastic bands together to form bracelets, anklets, necklaces and jewelry products has a circular platform having a plurality of substrate stations for retaining elastic bands in a semistretched configuration. An interlinking utensil allows a user to make cross-linked jewelry products which can be worn around a wrist or other area of the body. The substrate stations may be aligned in one or more rows.

17 Claims, 4 Drawing Sheets

(56) References Cited

U.S. PATENT DOCUMENTS

| | | | | | |
|---|---|---|---|---|---|
| 2,540,383 | A | * | 2/1951 | Tillert et al. | 28/149 |
| 2,601,222 | A | * | 6/1952 | Wehrli | 28/151 |
| 2,609,676 | A | * | 9/1952 | Woroneski | 66/4 |
| 2,658,364 | A | * | 11/1953 | Carlson | 66/4 |
| 2,687,630 | A | * | 8/1954 | Carlson | 66/117 |
| 2,703,482 | A | * | 3/1955 | Auran | 66/4 |
| 2,726,434 | A | * | 12/1955 | Knoblock et al. | 28/149 |
| D204,442 | S | * | 4/1966 | Brawley | D15/66 |
| 3,377,674 | A | * | 4/1968 | Brassaw et al. | 28/147 |
| 3,438,223 | A | * | 4/1969 | Linstead | 66/1 R |
| 3,476,423 | A | * | 11/1969 | Kentfield | 289/17 |
| 3,600,764 | A | * | 8/1971 | Froehlich | 24/545 |
| 3,636,987 | A | * | 1/1972 | Forby | 28/151 |
| 3,648,484 | A | * | 3/1972 | Gordon | 66/4 |
| 3,678,709 | A | * | 7/1972 | Nowicki et al. | 66/4 |
| 3,688,357 | A | * | 9/1972 | Nielsen et al. | 289/17 |
| 3,748,706 | A | * | 7/1973 | Doyel | 28/150 |
| 3,800,372 | A | * | 4/1974 | Daoust | 28/152 |
| 3,805,345 | A | * | 4/1974 | Antos | 28/149 |
| 3,854,179 | A | * | 12/1974 | Montoya | 28/147 |
| 3,905,133 | A | * | 9/1975 | Charman | 434/83 |
| 3,913,183 | A | * | 10/1975 | Brumlik | 24/447 |
| 3,967,467 | A | * | 7/1976 | Leach, Sr. | 66/4 |
| 4,023,245 | A | * | 5/1977 | Zaltzman | 28/152 |
| 4,032,179 | A | * | 6/1977 | Goss | 289/16.5 |
| 4,044,437 | A | * | 8/1977 | Ebenstein | 28/151 |
| 4,114,892 | A | * | 9/1978 | Csoka | 273/265 |
| 4,131,138 | A | * | 12/1978 | Boisvert | 139/29 |
| 4,158,296 | A | * | 6/1979 | Dunlop | 66/4 |
| 4,193,273 | A | * | 3/1980 | Palange | 66/4 |
| 4,246,768 | A | * | 1/1981 | Palange | 66/4 |
| 4,248,063 | A | * | 2/1981 | Wang | 66/4 |
| 4,362,032 | A | * | 12/1982 | Palange | 66/4 |
| 4,416,040 | A | * | 11/1983 | Towsley | 28/152 |
| 4,540,375 | A | * | 9/1985 | Fogarty et al. | 446/146 |
| 4,562,868 | A | * | 1/1986 | Jammes | 139/118 |
| 4,569,108 | A | * | 2/1986 | Schwab | 24/17 R |
| 4,629,100 | A | * | 12/1986 | Owens | 223/46 |
| 4,667,965 | A | * | 5/1987 | Helms, Jr. | 273/243 |
| 4,729,229 | A | * | 3/1988 | Whicker | 66/4 |
| D330,668 | S | * | 11/1992 | Nagamatsu | D8/71 |
| 5,231,742 | A | * | 8/1993 | Macbain | 28/151 |
| 5,268,210 | A | * | 12/1993 | Iijima | 428/39 |
| 5,639,090 | A | * | 6/1997 | Stevens | 273/287 |
| 5,687,775 | A | * | 11/1997 | Thompson et al. | 139/426 R |
| 5,927,764 | A | * | 7/1999 | Harriman | 289/17 |
| 6,065,968 | A | * | 5/2000 | Corliss | 434/83 |
| 6,129,551 | A | * | 10/2000 | Martin | 434/200 |
| 6,131,778 | A | * | 10/2000 | Etzion | 223/46 |
| 6,146,144 | A | * | 11/2000 | Fowler et al. | 434/81 |
| 6,149,436 | A | * | 11/2000 | Dunn | 434/83 |
| 6,171,317 | B1 | * | 1/2001 | Jackson et al. | 606/148 |
| D563,997 | S | * | 3/2008 | Gustin | D15/78 |
| 8,485,565 | B2 | * | 7/2013 | Ng | 289/17 |
| 8,684,420 | B2 | * | 4/2014 | Ng | 289/17 |
| D711,931 | S | * | 8/2014 | Daftari | D15/66 |
| 8,899,631 | B2 | * | 12/2014 | Ng | 289/17 |
| D721,744 | S | * | 1/2015 | Daftari | D15/66 |
| 8,931,811 | B1 | * | 1/2015 | Ng | 289/17 |
| 8,936,283 | B2 | * | 1/2015 | Ng | 289/17 |
| 8,955,888 | B2 | * | 2/2015 | Ng | 289/17 |
| 2008/0156043 | A1 | * | 7/2008 | Gustin | 66/4 |
| 2008/0223083 | A1 | * | 9/2008 | Gustin | 66/1 A |
| 2009/0215013 | A1 | * | 8/2009 | Molin | 434/191 |
| 2010/0212770 | A1 | * | 8/2010 | Weidler et al. | 139/33 |
| 2011/0259465 | A1 | * | 10/2011 | Schaub | 139/29 |
| 2012/0047960 | A1 | * | 3/2012 | Sasur | 66/1 A |
| 2012/0112457 | A1 | * | 5/2012 | Ng | 289/1.5 |
| 2013/0020802 | A1 | * | 1/2013 | Ng | 289/1.5 |
| 2013/0300114 | A1 | * | 11/2013 | Ng | 289/1.5 |
| 2013/0307267 | A1 | * | 11/2013 | Ng | 289/1.5 |
| 2014/0239635 | A1 | * | 8/2014 | Ng | 289/17 |
| 2014/0319834 | A1 | * | 10/2014 | Ng | 289/1.5 |

* cited by examiner 50
56
56
58
58
.313
.100
.250
54
52
.125
95.00°
60
.620
62
.300
64
.075
.247

PLATFORM FOR WEAVING INTERLINKING BANDS

CROSS-REFERENCE TO RELATED APPLICATIONS

This application claims priority to U.S. Provisional Application Ser. No. 61/838,952 filed on Jun. 25, 2014, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

BACKGROUND OF THE INVENTION

1. Field of the Invention

The present invention relates to a substrate for manufacturing customizable interlocked web products. More particularly, the invention relates to an apparatus and method for making bracelets and other products which are composed of elastic bands and may be customized by being interlinked in different patterns and by attaching charms to them.

2. Background Information

Ornamental bands such as bracelets, anklets and necklaces made of interlinked elastic materials such as rubber bands and other related materials are popular accessories that people wear to represent school spirit, group associations and other symbolic forms of expressions. Bands can be worn on the arms and also on other areas of the body such as on the ankles. These bands are very difficult to manufacture by hand, as skill in the art and a great quantity of time is required, which many people do not have.

Finding ready-made elastic jewelry products customized to an individual's needs can be very difficult, and also very expensive, as the need to purchase more jewelry increases.

It is therefore desirable to provide a device which can easilyist any person wishing to sevl lined bands to form a braceletther device.

It is also desirable to provide an easy method of creating such interlinked bands performable by anyone regardless of knowledge or skill.

It is also desirable to provide a device which allows an easy method of creating customizable elastic jewelry products.

BRIEF SUMMARY OF THE INVENTION

The principles of the invention provide a device and method which allows the end user to conveniently cross link elastic materials such as rubber bands by providing an easy to use pin wheel guiding platform, and an interlocking utensil.

An object of the invention is to provide an easy method of making a customizable elastic jewelry products and one that is more economical for the average end user.

Another object of the invention is to provide a new and unique type of jewelry making device which allows the user to make customizable products which may not be available on the market.

In one embodiment, a platform has a plurality of substrate stations. Each substrate stations have a pair of upwardly protruding, cylindrical stems. The stems each have a bulbous cap that may protrude more in one direction, such as away from each stem. The plurality of substrate stations may be arranged in one or more rows, and may be numbered and/or provided a beginning and end point for each row. The stems may protrude from a pedestal, or other base-like structure at the bottom of the substrate station.

In use, elastic bands may be placed on each pin pair of each substrate station and subsequently interlinked with one another to produce a bracelet, necklace or other woven product. A utensil may be used to assist in interlinking the bands. The bands may be interlinked in a variety of different patterns. Charms or other objects may also be used to ornament the web product.

In another embodiment, a platform for weaving interlinking elastic bands comprises a platform having a top surface and a plurality of stations on the top surface. The stations are aligned into one or more rows.

Each of the stations comprises a pedestal, two stems extending upward from the pedestal, each of the stems having a crown.

In one embodiment, the stations are removably attached to the platform. The platform may further comprise one or more storage wells, and/or a clip for holding a weaving utensil and a weaving utensil.

In another embodiment, the platform is circular. The crowns of the stems may be spherical or oblong. If they are oblong, they may face away from each other and/or be perpendicular to the direction of the rows.

In another embodiment, the stations are removably attached to the platform and the platform may include one or more storage wells.

Also disclosed is a method for weaving interlinking bands comprising the steps of a) stretching an elastic band between two or more stems of two or more stations of a platform having a plurality of stations aligned into one or more rows such that tension created by the stretching holds the band in place suspended between the two or more stems, b) stretching another elastic band between two or more stems of two or more stations of a platform having a plurality of stations aligned into one or more rows such that tension created by the stretching holds the band in place suspended between the two or more stems, c) pulling a portion of one of the elastic bands through the elastic band by means of a weaving utensil, d) attaching the portion of the elastic band pulled through another elastic band to at least one stem such that tension caused by stretching the elastic band holds the portion in place about the at least one stem; and repeating steps a-d to provide a plurality of interwoven elastic bands.

The method for weaving interlinking elastic bands may use stems includes a spherical or oblong crowns, which may be perpendicular to the rows.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
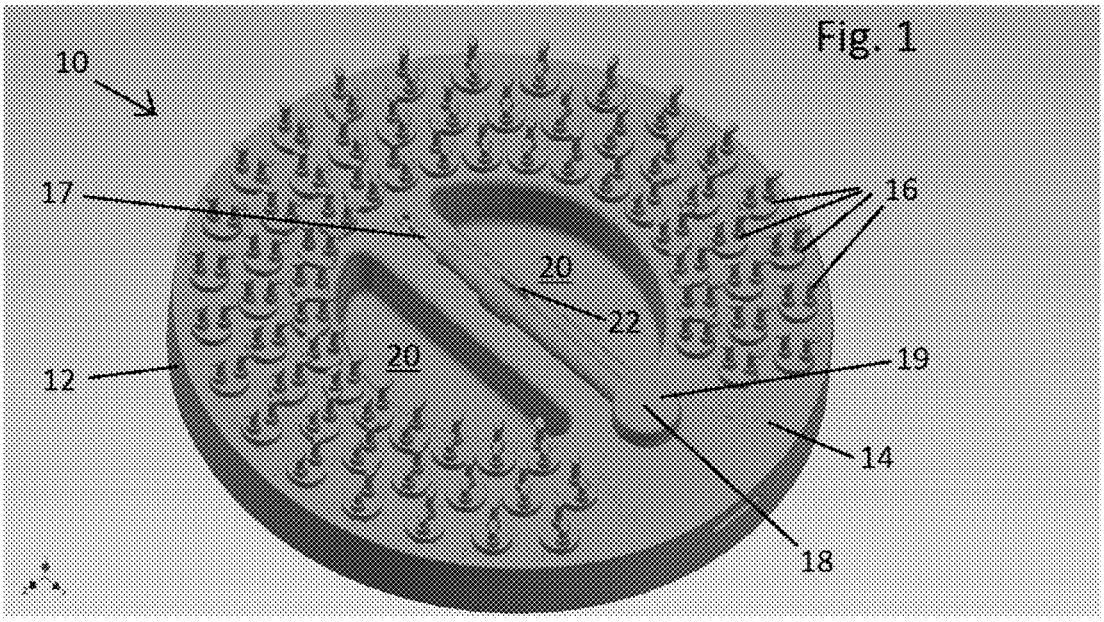
FIG. 1 is a perspective view of a circular platform for weaving interlinking elastic bands in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

FIG. 1 shows a circular platform for weaving interlinking bands 10 in accordance with the principles of the invention. Platform 10 is comprised of a base 12 in the shape of a flattened cylinder. The base 12 has a top surface. The top surface 14 may include two storage wells 20 that may be used to store elastic bands or other materials. Top surface 14 may also include a clip 22 for securing a weaving utensil 18 to the top surface 14 when not in use. In this embodiment, the weaving utensil 18 may be elongate having a handle 19 on one end and a weaving hook 17 on the opposite end.

A large portion of top surface 14 may be covered by a plurality of stations 16. Each station 16 may be designed to accommodate one or more elastic bands during the weaving process. The stations 16 may be arranged in one or more rows.

Figure 2:
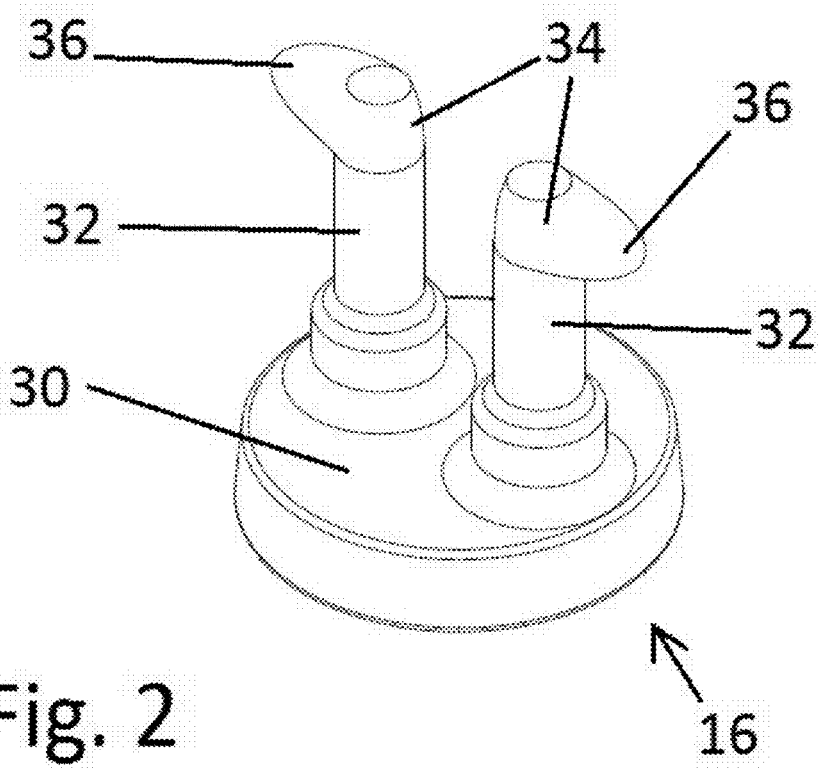
FIG. 2 is a perspective view of a station in accordance with the principles of the invention.

FIG. 2 is an enlarged view of a station 16. Stations 16 may have a pedestal 30 serving as a base for the station 16. Two stems 32 may extend upward from the pedestal 30. Each of stems 32 may have a crown 34 at the top. Each crown 34 may be spherical, oblong, parallelepiped or other shape. The crown may include a distal end 36 extending at least partially perpendicular to the stem 32. In this embodiment, the distal ends 36 of the oblong "egg-shaped" crowns 34 extend away from each other, may be substantially perpendicular to the stems 32 and may have rounded edges. In other embodiments, it may be desirable for the distal ends 36 of the crowns 34 to extend in the same direction, perpendicular to each other, or at an acute or obtuse angle relative to each other.

Stems 32 may be substantially cylindrical and rigid. It is generally desirable for the stems 32 to be rigid in order to securely retain elastic bands in a semi-extended form, and held in place by tension resulting from the elastic bands being stretched over two or more stems. In some embodiments, it may not be desirable for stems 32 to be completely rigid. It may also be desirable for stems 32 to have an oval or polygonal cross-section instead of being cylindrical. Similarly, in this embodiment, pedestal 30 is cylindrical. It may be desirable for pedestal 30 to be more prismatic or rectangular. Optionally, it may be desirable for the pedestal 30 to be rounded, or have a hemispherical shape. This embodiment of a station 16 has bilateral symmetry. Stations may optionally have other types of symmetry or none at all.

Figure 3:
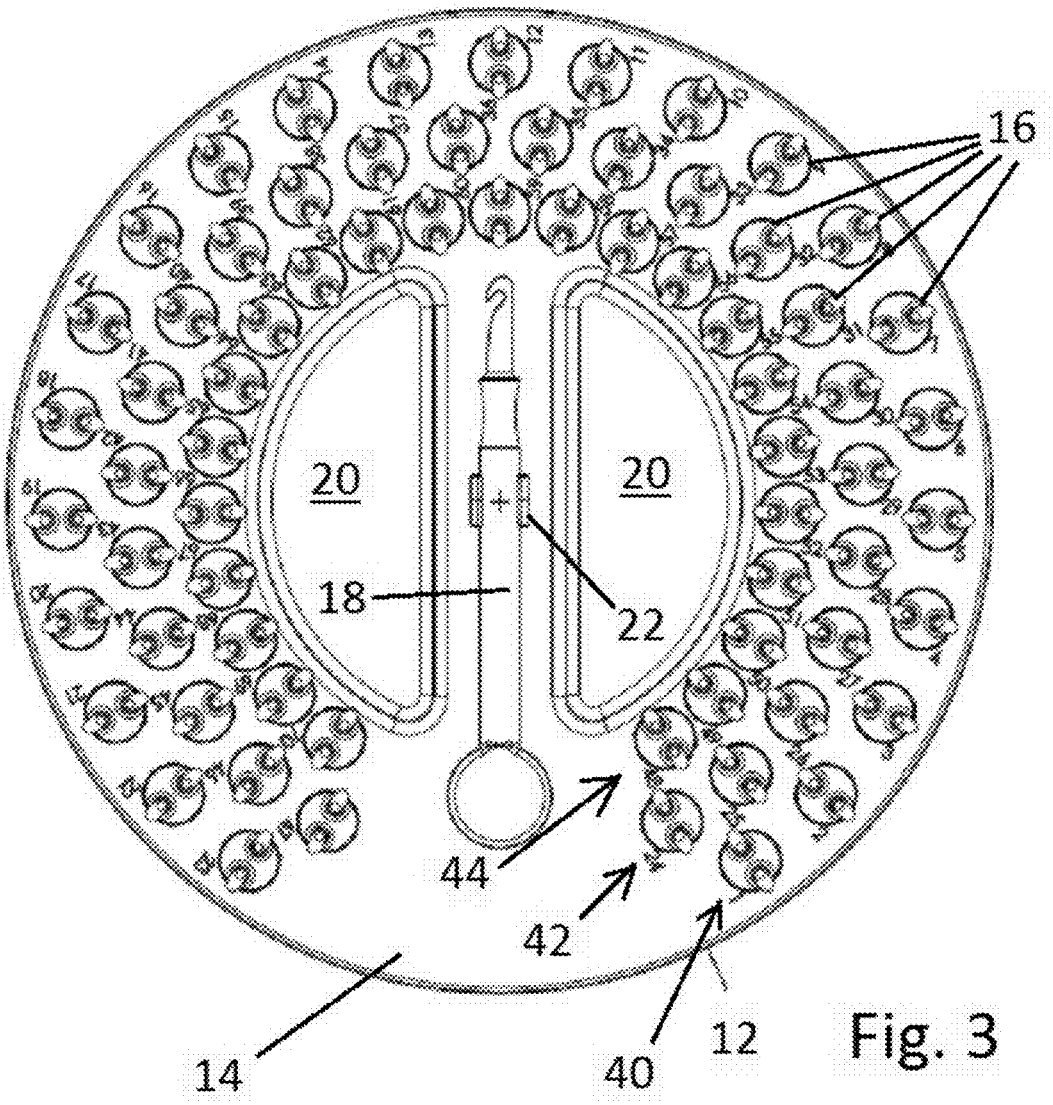
FIG. 3 is top view of the circular platform for weaving interlinking bands in accordance with the principles of the invention.

FIG. 3 shows a top view of the circular platform 10. It may be seen that top surface 14 is substantially bilaterally symmetric. As a result, wells 20 may be symmetrical. The stations 16 may be generally aligned in rows as shown here. An outer row 40, central row 42 and inner row 40. are substantially parallel to each other. The top surface 14 may include numbering in order to designate each individual substrate station 16 for ease of use.

Figure 4:
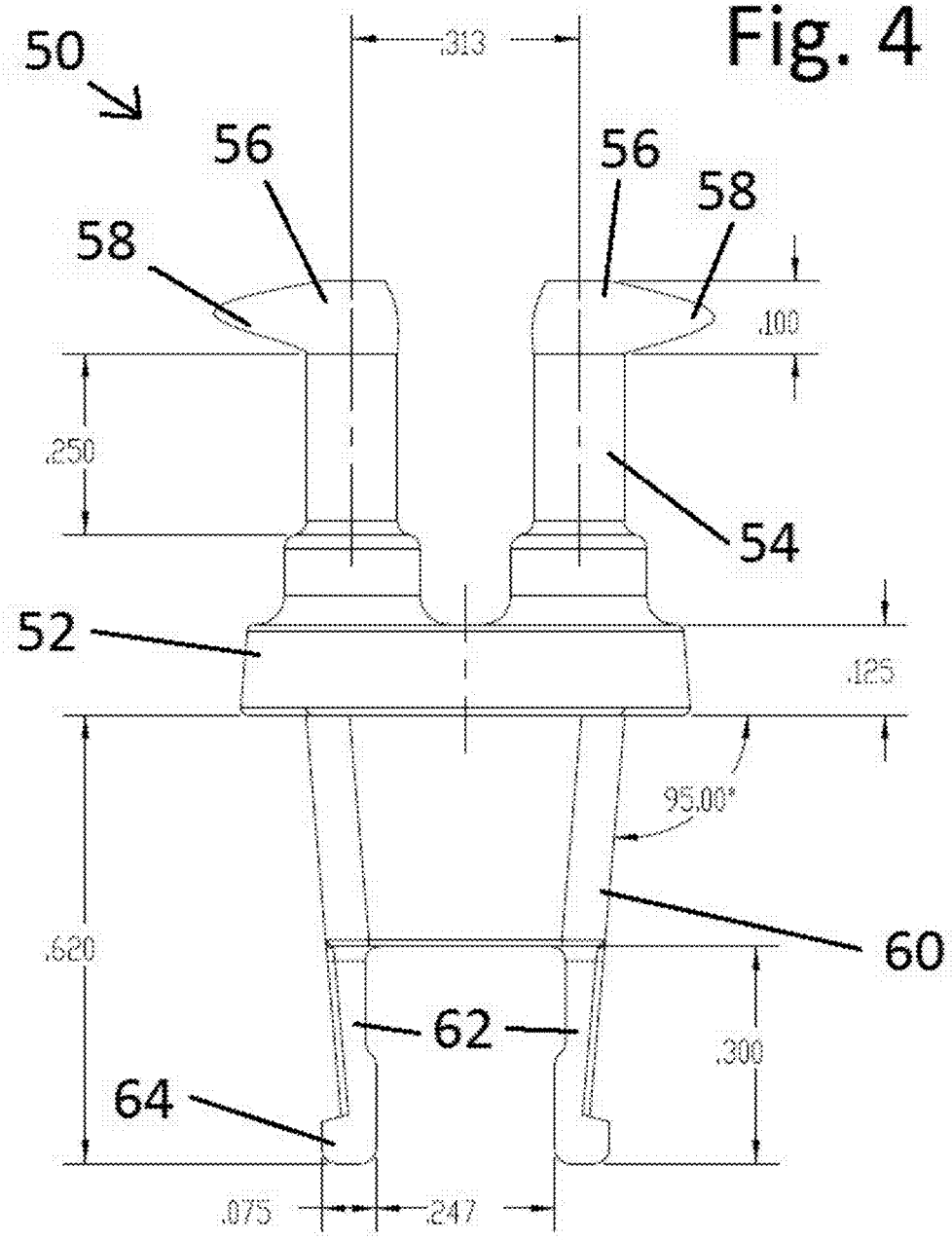
FIG. 4 is a side view of a removably attachable station use with removable stations in accordance with the principles of the invention.
Figures 5, 6, 7:
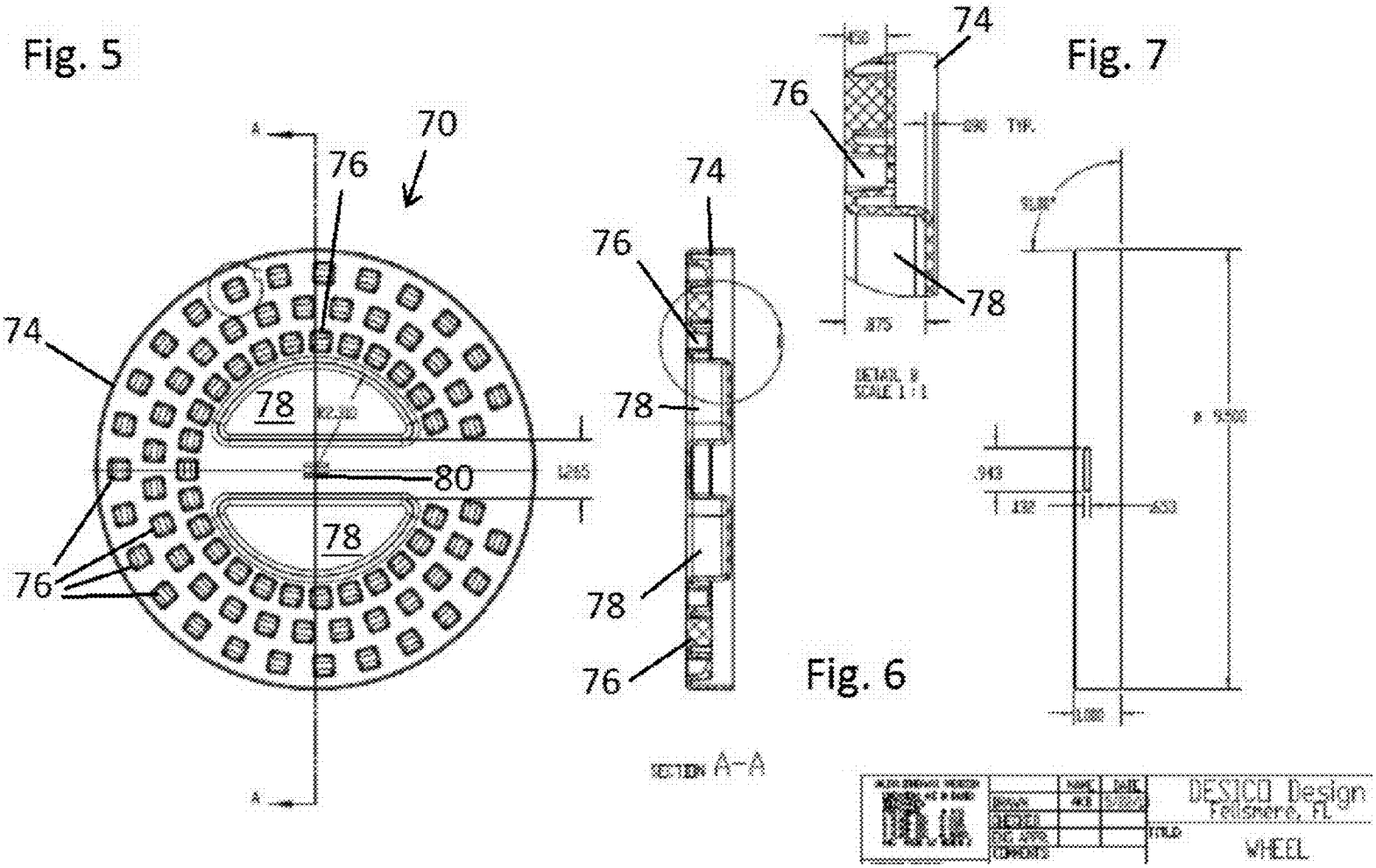
FIG. 5 is an alternative top view of a circular platform having a plurality of sockets for removable attachment of stations in accordance with the principles of the invention.
FIG. 6 is a cross-sectional side view of a circular platform having a plurality of sockets for removable attachment of stations in accordance with the principles of the invention.
FIG. 7 is an enlarged view of a portion of a cross-sectional side view of a circular platform having a plurality of sockets for removable attachment of stations in accordance with the principles of the invention.

FIG. 4 shows a side view of a removably attachable station 50, designed as a unitary manufactured piece for integration with a separately manufactured platform shown in FIGS. 5-7. Removably attachable station 50 includes a pedestal 52 and two stems 54. As with substrate station 16 in FIGS. 1-3, pedestal 52 is a flattened cylinder. Stems 54 are topped by crowns 56, each having an oblong shape. Station 50 includes a bottom portion 60 having two downwardly protruding fingers 62 each having a tab 64 that snaps into place when the station 50 is attached to a platform.

FIG. 5 shows a circular platform 70 having a plurality of substrate station sockets 76 arranged in three rows on the top surface 74 of platform 70. Storage wells 78 may be used to hold objects while clamp 80 may be used to hold a weaving utensil (not shown). A station 52, as shown in FIG. 4 may be snapped into each of the station sockets 76. FIG. 6 shows a cross-sectional view of platform 70 along axis A and FIG. 7 shows an enlarged view of a portion of FIG. 6. In both FIGS. 6 and 7 it may be seen that wells 78 and sockets 76 are cavities within platform 70. By providing removable attachment of stations into sockets on a platform, the weaving platform in accordance with the principles of the invention allows simple repair and/or replacement of stations. Because the stems are relatively thin and are exposed to forces imparted by elastic bands stretched over them, they may be prone to breaking The platforms in the embodiments are circular having three rows. Optionally, the platforms may be rectangular, ovoid, or any other shape and may have only one row, or may have more than three rows running parallel.

In use, elastic bands are stretched over two or more stems, either on the same station or on neighboring stations. A weaving utensil may then be used to pull a portion of one of the elastic bands through another band. The stretched portion may then be attached to another stem. In this manner, a Brunnion link is formed, connecting the two bands. This process is continued for many elastic bands over many stems to form a long chain of elastic bands all interconnected by means of Brunnion links.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A platform for weaving interlinking elastic bands comprising:

a solid, unitary platform having a top surface;

a plurality of stations on the top surface;

wherein the stations are aligned into one or more rows; and, wherein each of the stations comprises a pedestal having a solid, unitary body with a flat top and extending upward from the top surface of the platform and two stems extending upward from the flat top surface of the pedestal, each of the stems having a crown;

wherein a plane intersecting the two stems of a station is substantially perpendicular to the direction of the row in which the station is aligned.

2. The platform for weaving interlinking elastic bands of claim 1 wherein the stations are removably attached to the platform.

3. The platform for weaving interlinking elastic bands of claim 1 wherein the platform further comprises one or more storage wells.

4. The platform for weaving interlinking elastic bands of claim 1 wherein the platform further comprises a clip for holding a weaving utensil.

5. The platform for weaving interlinking elastic bands of claim 4 further comprising a weaving utensil.

6. The platform for weaving interlinking elastic bands of claim 1 wherein the platform is circular.

7. The platform for weaving interlinking elastic bands of claim 1 wherein the crowns are spherical.

8. The platform for weaving interlinking elastic bands of claim 1 wherein the crowns are oblong.

9. The platform for weaving interlinking elastic bands of claim 6 wherein the oblong crowns face away from each other.

10. The platform for weaving interlinking elastic bands of claim 6 wherein the oblong crowns are perpendicular to the rows.

11. The platform for weaving interlinking elastic bands of claim 8 wherein the stations are removably attached to the platform.

12. The platform for weaving interlinking elastic bands of claim 9 wherein the platform further comprises one or more storage wells.

13. The platform for weaving interlinking elastic bands of claim 10 wherein the platform further comprises a clip for holding a weaving utensil.

14. The platform for weaving interlinking elastic bands of claim 11 wherein the platform is circular.

15. The platform for weaving interlinking elastic bands of the claim 1 wherein the each of the pedestals of the stations are cylindrical.

16. The platform for weaving interlinking elastic bands of the claim 1 wherein a plane intersecting the two stems of a station is substantially perpendicular to the direction of the row in which the station is aligned.

17. The platform for weaving interlinking elastic bands of claim 2 wherein the platform has a plurality of station sockets arranged in rows on the top surface; and wherein the removable stations include a bottom portion having two downwardly protruding fingers, each finger having a tab that snaps into place when the station is inserted into one of the station sockets.

* * * * *